US009446775B2

(12) United States Patent
Yoshizu et al.

(10) Patent No.: US 9,446,775 B2
(45) Date of Patent: Sep. 20, 2016

(54) BOGIE FRAME FOR RAILWAY VEHICLES

(71) Applicant: NIPPON STEEL & SUMITOMO METAL CORPORATION, Tokyo (JP)

(72) Inventors: Tatsuya Yoshizu, Osaka (JP); Nobuaki Kaneyasu, Higashiosaka (JP); Takehiro Kadonaka, Kobe (JP); Satoshi Tokunaga, Nishinomiya (JP); Satoshi Kikko, Amagasaki (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/418,092

(22) PCT Filed: Jul. 17, 2013

(86) PCT No.: PCT/JP2013/004357

§ 371 (c)(1),
(2) Date: Jan. 29, 2015

(87) PCT Pub. No.: WO2014/027440

PCT Pub. Date: Feb. 20, 2014

(65) Prior Publication Data

US 2015/0203132 A1 Jul. 23, 2015

(30) Foreign Application Priority Data

Aug. 13, 2012 (JP) ..... 2012-179373

(51) Int. Cl.
*B61F 5/00* (2006.01)
*B61F 5/52* (2006.01)

(52) U.S. Cl.
CPC ..... *B61F 5/52* (2013.01)

(58) Field of Classification Search
CPC ..... B61F 5/52; B23K 9/00
USPC ..... 105/197–206
See application file for complete search history.

(56) References Cited

U.S. PATENT DOCUMENTS 2,098,459 A * 11/1937 McWhirter ..... B61F 3/04 105/167
3,948,188 A * 4/1976 Zehnder ..... B60G 11/04 105/167
4,173,933 A * 11/1979 Kayserling ..... B61F 5/148 105/182.1

(Continued)

FOREIGN PATENT DOCUMENTS

JP 3873659 1/2007
JP 4292980 7/2009

(Continued)

*Primary Examiner* — Jason C Smith
(74) *Attorney, Agent, or Firm* — Clark & Brody

(57) ABSTRACT

A bogie frame for railway vehicles includes a pair of left and right side beams disposed along a direction of rails; a cross beam that connects the side beams to each other, and a mounting bracket for mounting a functional part, the mounting bracket being joined to the cross beam. The cross beam has a rectangular cross section and includes a top plate section, a bottom plate section, and a pair of side plate sections. The top plate section has a cutout opening extending to one of the side plate sections. The mounting bracket is inserted in the cutout opening and the mounting bracket and the top plate section are butt welded together. This configuration enhances welding workability for welding mounting brackets for mounting functional parts such as a traction motor, a gearbox, and a brake, and allows a greater degree of design flexibility in mounting the functional parts.

4 Claims, 6 Drawing Sheets

(56) References Cited

U.S. PATENT DOCUMENTS 4,175,772 A * 11/1979 Lampert ..... B60G 17/023 267/262
4,242,966 A * 1/1981 Holt ..... B61F 5/04 105/182.1
4,332,201 A * 6/1982 Pollard ..... B61F 3/04 105/167
4,363,277 A * 12/1982 Martin ..... B61F 5/22 105/164
4,648,326 A * 3/1987 Jackson ..... B61F 3/04 105/138
4,742,779 A * 5/1988 Bevand ..... B61F 3/04 105/167
5,020,824 A * 6/1991 Mounier-Poulat ..... B60G 5/053 267/266
5,039,071 A * 8/1991 Irle ..... B61F 5/148 105/197.05
5,632,208 A * 5/1997 Weber ..... B61F 3/10 105/182.1
6,119,602 A * 9/2000 Yoshino ..... B61F 5/305 105/167
6,250,232 B1 * 6/2001 Hachmann ..... B61F 5/325 105/157.1
6,338,300 B1 * 1/2002 Landrot ..... B61F 5/305 105/182.1
7,934,458 B2 * 5/2011 Gedenk ..... B61F 5/307 105/197.05
8,640,630 B2 * 2/2014 Gilmartin ..... B61F 5/24 105/199.2
8,813,654 B2 * 8/2014 Muller ..... B61F 5/52 105/172
2005/0116436 A1 * 6/2005 Landrot ..... B61F 5/305 280/124.109
2008/0229968 A1 * 9/2008 Gedenk ..... B61F 5/305 105/198.7
2010/0107923 A1 * 5/2010 Rodet ..... B61F 5/325 105/197.05
2011/0247520 A1 * 10/2011 Liu ..... B61F 3/02 105/197.05
2012/0240813 A1 * 9/2012 Becher ..... B61F 5/52 105/157.1
2012/0318164 A1 * 12/2012 Shinmura ..... B61C 17/00 105/138
2014/0123870 A1 * 5/2014 Nishimura ..... B61F 5/302 105/197.05
2015/0000553 A1 * 1/2015 Kimura ..... B61F 5/30 105/197.05
2015/0020708 A1 * 1/2015 Nishimura ..... B61F 5/302 105/197.05
2015/0083019 A1 * 3/2015 Nishimura ..... B61F 5/32 105/197.05
2015/0107487 A1 * 4/2015 Zanutti ..... B61F 5/325 105/172
2015/0151768 A1 * 6/2015 Hagio ..... B61C 9/50 105/202
2015/0158506 A1 * 6/2015 Nishimura ..... B61F 5/52 105/197.05
2015/0203132 A1 * 7/2015 Yoshizu ..... B61F 5/52 105/206.2
2015/0251670 A1 * 9/2015 Kamura ..... B61F 5/305 105/197.05

FOREIGN PATENT DOCUMENTS

JP 2012-046069 3/2012
KP 10-2002-0061487 7/2002

* cited by examiner (a)

(b)

(a)

(b)

(a)

(b)

BOGIE FRAME FOR RAILWAY VEHICLES

TECHNICAL FIELD

The present invention relates to a bogie frame for railway vehicles, with particular attention to its mounting brackets for mounting functional parts such as a traction motor, a gearbox, and a brake to the bogie frame. More specifically, the present invention relates to a bogie frame for railway vehicles which is provided with enhanced welding workability for the mounting brackets to be welded to the bogie frame and also with a greater degree of design flexibility for the positions where functional parts are mounted.

BACKGROUND ART

In general, railway vehicles are composed of a vehicle body and a bogie that supports the vehicle body, and functional parts such as traction motors, gearboxes, brakes, and the like are mounted to a bogie frame of the bogie. Railway vehicles run on rails on power transmitted from traction motors to wheel sets through gearboxes, and braking is applied by actuating the braking system, which causes the rotation of the wheel sets to be inhibited, for example.

FIG. 1 is a plan view of a conventional bogie frame. FIG. 2 is a cross-sectional view of cross beams of the conventional bogie frame, schematically showing an example of a configuration for mounting a functional part. FIG. 2 is a sectional view, taken along the direction of rails, in which a vehicle body 5 and a center pin 6 of the vehicle body are also clearly shown for ease of understanding of the configuration.

As shown in FIG. 1, the bogie frame includes a pair of left and right side beams 1 disposed along the direction of rails and the cross beams 2 that connect the side beams 1 to each other. The cross beams 2 are constituted by two round pipes having a circular cross section arranged in parallel to each other as shown in FIG. 2, and each of them is welded at both ends thereof to the side beams 1. To ensure integral stiffness of the two round pipe cross beams 2, a pair of upper and lower reinforcing plates 2*a* and 2*b* is disposed between the cross beams 2 and welded to them.

The cross beams 2 are provided with mounting brackets 3 for mounting a functional part, each welded to the outer peripheral surfaces of the cross beams 2. The mounting brackets 3 include a mounting bracket 3*a* for mounting a traction motor, a mounting bracket 3*b* for mounting a gearbox, and a mounting bracket 3*c* for mounting a brake. FIG. 2 illustrates a state in which the mounting bracket 3 has been welded to the outside half of the outer peripheral surface of one of the two round pipe cross beams 2, and a traction motor, as a functional part 4, has been attached to the mounting bracket 3. The mounting bracket 3 is formed of a plurality of steel plates welded to each other.

It is to be noted that functional parts such as a traction motor, a gearbox, and a brake impose a heavy load on the bogie frame (cross beams), and therefore it is essential that mounting brackets for mounting a functional part be firm and solid with high fatigue strength. However, a mounting bracket formed of a plurality of steel plates welded to each other has a reduced fatigue strength (according to JIS-E-4207 (Japanese Industrial Standards), for example) at the weld zone where it is welded to the cross beam and at the weld zones of the mounting bracket-forming steel plates where they are welded together, as compared to the base metal regions of the steel plates. Because of this, measures for inhibiting an unwanted decrease in fatigue strength of a mounting bracket are desired.

As a conventional technique that addresses this need, Patent Literature 1 discloses a technique of modifying the shapes of the steel plates that constitute the mounting bracket to reduce stress. Furthermore, Patent Literature 2 discloses a technique of improving the quality of the weld joint by optimizing the welding procedure when fabricating the mounting bracket as well as by modifying the shapes of the steel plates that constitute the mounting bracket.

However, in bogie frames of the conventional type as shown in FIGS. 1 and 2, including the ones disclosed in Patent Literatures 1 and 2, there are many short weld lines and curved weld lines. This is because the mounting bracket 3 is formed of a plurality of steel plates welded to each other, and further, the mounting bracket 3 is welded to the outer peripheral surface of the cross beams 2 which are constituted by round pipes. Consequently, this is likely to reduce the efficiency of the work of welding and increase the difficulty in automatic welding by a welding robot.

Furthermore, as a matter of fact, different types of functional parts having different weights and performance (acting forces, loads, and the like) are used in accordance with individual specifications of railway vehicles. Hence, the positions at which functional parts are to be mounted in the bogie frame (cross beam) cannot be uniformly determined, and thus separate design is necessary for each railway vehicle specifications. In this regard, the conventional techniques address the need by modifying the size and shape of the mounting bracket, i.e., the size and shape of the steel plates constituting the mounting bracket so as to conform to the positions where functional parts which are in conformity with specifications of railway vehicles are mounted. Needless to say, in the design modification, it is necessary to form the mounting bracket into a shape that provides sufficient strength so as to prevent a decrease in fatigue strength of the mounting bracket.

However, with conventional bogie frames, difficulties may arise in mounting a functional part. The difficulties are described in the following.

FIG. 3 is a cross-sectional view of cross beams of the conventional bogie frame, schematically showing an example of the difficulties encountered in mounting a functional part. FIG. 3 shows a sectional view taken along the direction of rails as with FIG. 2.

FIG. 3 shows a case in which a functional part 4 is to be mounted to one of the two round pipe cross beams 2 at a location lower than the top thereof and close thereto, as required by certain specifications of railway vehicles. In this case, there is no space for placement of a mounting bracket and thus the functional part 4 interferes with the cross beam 2. In this case, mounting of the functional part 4 cannot be accomplished by any modifications to the size and shape of the mounting bracket, and therefore the overall dimensional configuration of the bogie frame, including that of the cross beams 2, must be revised. Thus, the conventional bogie frame has a significantly low degree of design flexibility for the positions where functional parts are mounted.

CITATION LIST

Patent Literature

Patent Literature 1: Japanese Patent No. 4292980
Patent Literature 2: Japanese Patent No. 3873659

SUMMARY OF INVENTION

Technical Problem

The present invention has been made in view of the foregoing problems. Accordingly, it is an object of the present invention to provide a bogie frame for railway vehicles which has enhanced welding workability for welding thereto mounting brackets for mounting a functional part and also allows a greater degree of design flexibility for the positions where functional parts are mounted.

Solution to Problem

In order to achieve the above object, the present inventors intensively searched for techniques that allow mounting of functional parts to suitable positions in accordance with individual specifications of railway vehicles, while satisfying the conditions under which weld lines that are formed when mounting brackets for mounting a functional part are welded to the cross beam are relatively long and straight, and further, not necessitating a change of the overall dimensional configuration of the bogie frame including that of the cross beam. Consequently, they have found that it is advantageous to: adopt a cross beam configuration with a rectangular cross section which includes a top plate section, a bottom plate section and a pair of side plate sections; and then form a cutout opening in the top plate section in such a manner that it extends to one of the side plate sections, insert a mounting bracket in the cutout opening, and join the mounting bracket to the top plate section by butt welding.

The present invention has been accomplished based on this finding, and the summaries thereof are set forth below as to a bogie frame for railway vehicles. Specifically, there is provided a bogie frame for railway vehicles, comprising: a pair of left and right side beams disposed along a direction of rails; a cross beam that connects the side beams to each other; and a mounting bracket for mounting a functional part, the mounting bracket being joined to the cross beam, wherein the cross beam has a rectangular cross section and includes a top plate section, a bottom plate section, and a pair of side plate sections; the top plate section has a cutout opening extending to one of the side plate sections; the mounting bracket is inserted in the cutout opening; and the mounting bracket and the top plate section are joined together by butt welding.

In the above-mentioned bogie frame, it is preferred that the mounting bracket is a monolithically formed component formed by forging or machining.

Furthermore, in the above-mentioned bogie frame, it is preferred that the cross beam comprises a joined-four-plate body, a rectangular pipe, or a press formed product.

Advantageous Effects of Invention

The bogie frame for railway vehicles of the present invention is capable of being provided with enhanced welding workability because the weld lines, formed between the cross beam and the mounting brackets for mounting a functional part when the mounting brackets are welded to the cross beam, are relatively long and straight. Moreover, a variety of types of functional parts can be mounted to the cross beam simply by modifying the sizes and shapes of the mounting bracket and the cutout opening in accordance with individual specifications of railway vehicles. Thus, it is possible to provide a greater degree of design flexibility for the positions where functional parts are mounted.

BRIEF DESCRIPTION OF DRAWINGS

FIG. 4(*a*) shows a state in which the functional part and the mounting bracket are detached from the cross beam, and FIG. 4(*b*) shows a state in which the mounting bracket has been joined to the cross beam and the functional part has been mounted thereon.

FIG. 5(*a*) shows a state in which the functional part and the mounting bracket are detached from the cross beam, and FIG. 5(*b*) shows a state in which the mounting bracket has been joined to the cross beam and the functional part has been mounted thereon.

FIG. 6(*a*) shows a state in which the functional part and the mounting bracket are detached from the cross beam, and FIG. 6(*b*) shows a state in which the mounting bracket has been joined to the cross beam and the functional part has been mounted thereon.

FIG. 7(*a*) shows a state in which the functional part and the mounting bracket are detached from the cross beam, and FIG. 7(*b*) shows a state in which the mounting bracket has been joined to the cross beam and the functional part has been mounted thereon.

FIG. 8(*a*) shows a state in which the functional part and the mounting bracket are detached from the cross beam, and FIG. 8(*b*) shows a state in which the mounting bracket has been joined to the cross beam and the functional part has been mounted thereon.

DESCRIPTION OF EMBODIMENTS

Hereinafter, embodiments of the bogie frame for railway vehicles of the present invention are described in detail.

First Embodiment

Figure 1:
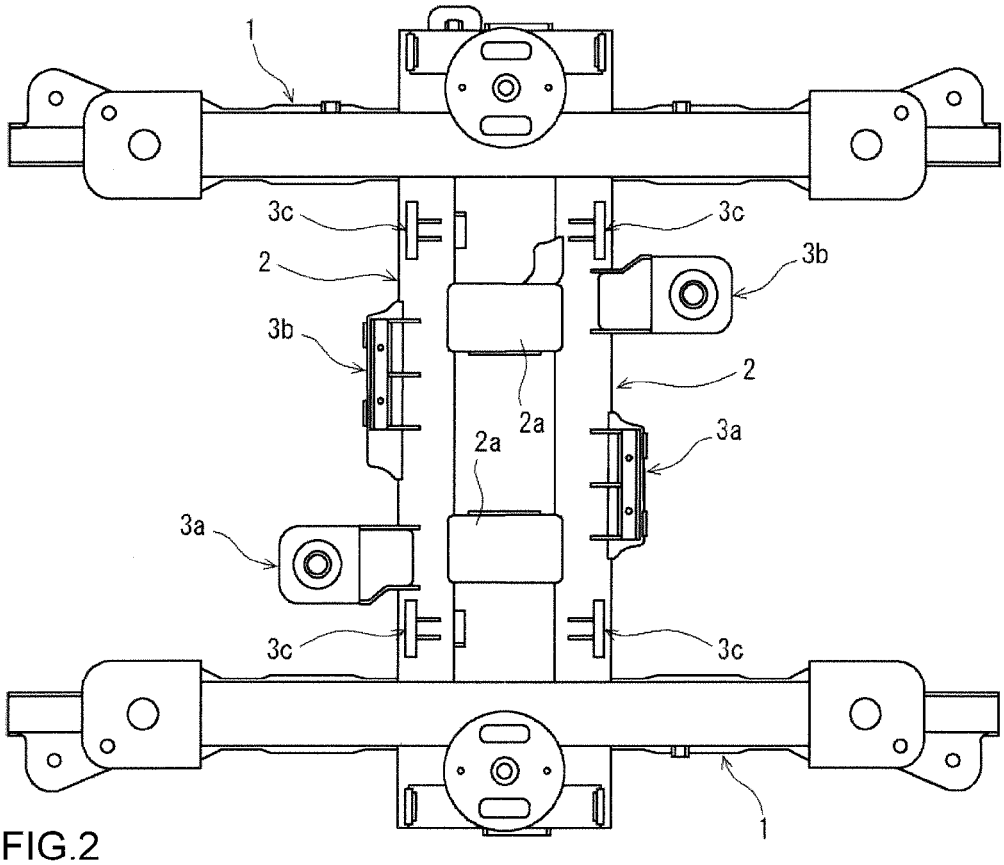
FIG. 1 is a plan view of a conventional bogie frame.
Figure 2:
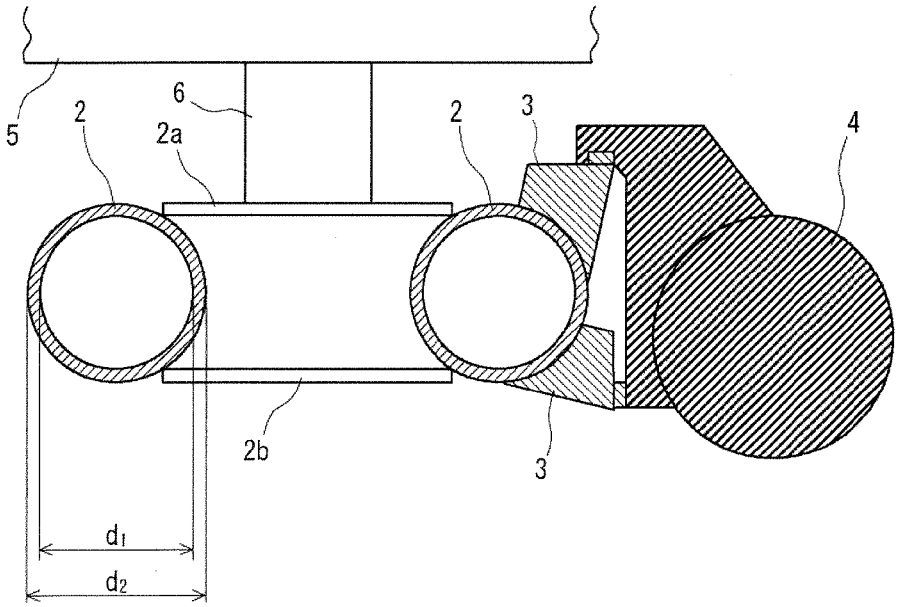
FIG. 2 is a cross-sectional view of cross beams of the conventional bogie frame, schematically showing an example of a configuration for mounting a functional part.
Figure 3:
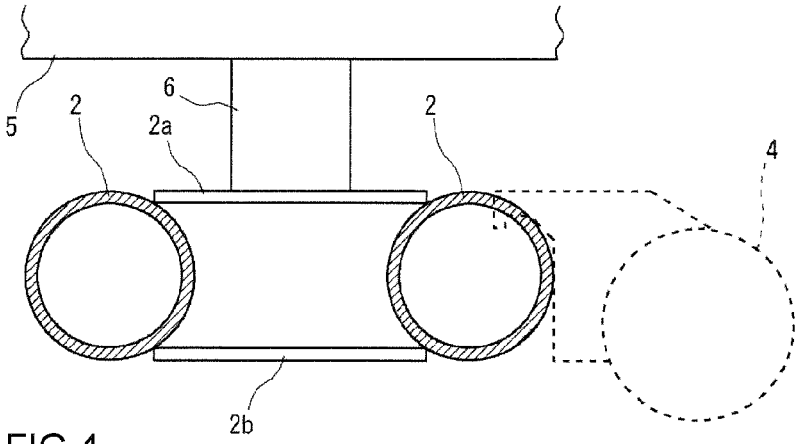
FIG. 3 is a cross-sectional view of the cross beams of the conventional bogie frame, schematically showing an example of the difficulties encountered in mounting a functional part.
Figure 4:
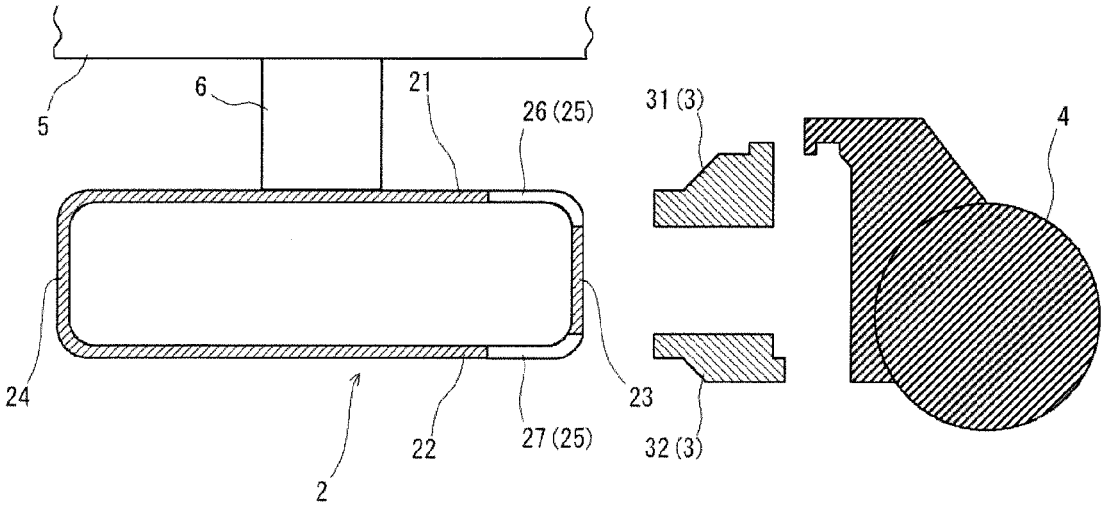
FIG. 4 shows cross-sectional views of a cross beam of the bogie frame in accordance with a first embodiment of the present invention, which schematically shows an example of a configuration for mounting a functional part.
Figure 4:
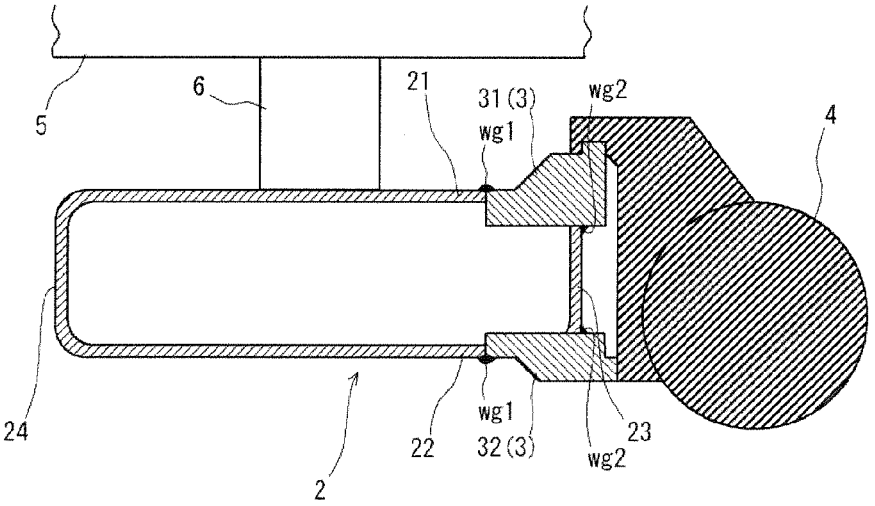

FIG. 4 shows cross-sectional views of a cross beam of the bogie frame in accordance with a first embodiment of the present invention, which schematically shows an example of a configuration for mounting a functional part. FIG. 4(*a*) shows a state in which the functional part and the mounting bracket are detached from the cross beam, and FIG. 4(*b*) shows a state in which the mounting bracket has been joined to the cross beam and the functional part has been mounted thereon. FIG. 4 shows sectional views taken along the direction of rails as with FIG. 2, with a traction motor being illustrated as the functional part 4. The same applies to the later-described second to fifth embodiments. The bogie frame of the first embodiment shown in FIG. 4 is based on the configuration of the bogie frame shown in FIGS. 1 and 2, and therefore redundant descriptions may not be repeated when appropriate.

In the first embodiment, the mounting bracket 3 is composed of two vertically separate parts, an upper bracket member 31 and a lower bracket member 32, as shown in FIG. 4. The upper bracket member 31 holds the functional part 4 at an upper portion thereof, and the lower bracket member 32 holds the functional part 4 at a lower portion thereof. Both the upper bracket member 31 and the lower bracket member 32 are monolithically formed components.

Preferably, this mounting bracket 3 (the upper bracket member 31 and the lower bracket member 32), which is a monolithically formed component, may be one formed by forging or machining. By using a forging or machining process, it is possible to form the mounting bracket 3 relatively easily even if it has a complex shape and to greatly increase the strength of the mounting bracket 3 itself (base metal region).

The cross beam 2 has a horizontally elongated rectangular cross section and includes a top plate section 21, a bottom plate section 22, and a pair of side plate sections 23, 24. The cross beam 2 of the first embodiment is composed of a rectangular pipe having a horizontally elongated cross section. Alternatively, the cross beam 2 may be constructed by joining together a pair of press formed products having a channel-shaped cross section by welding, or by joining together a press formed product having a channel-shaped cross section and a steel plate by welding.

As shown in FIG. 4(*a*), the top plate section 21 of the cross beam 2 has an upper cutout opening 26, extending to one of the side plate sections 23 (the right-hand side plate section in FIG. 4), for receiving the upper bracket member 31. The bottom plate section 22 of the cross beam 2 has a lower cutout opening 27, similarly extending to one of the side plate sections 23, for receiving the lower bracket member 32. These upper cutout opening 26 and the lower cutout opening 27 are hereinafter also collectively referred to as a cutout opening 25.

The upper bracket member 31 is inserted in the upper cutout opening 26 of the cross beam 2, and a groove is formed as appropriate in the upper bracket member 31 in conformity with the contour of the upper cutout opening 26, and then a welding process is applied. As shown in FIG. 4(*b*), the upper bracket member 31 is joined to the top plate section 21 of the cross beam 2 by butt welding, and joined to the side plate section 23 (as well as a portion of the top plate section 21 closer to the side plate section 23, to be exact) by fillet welding.

Likewise, the lower bracket member 32 is inserted in the lower cutout opening 27 of the cross beam 2, and the lower bracket member 32 is subjected to welding along the contour of the lower cutout opening 27. As shown in FIG. 4(*b*), the lower bracket member 32 is joined to the bottom plate section 22 of the cross beam 2 by butt welding, and joined to the side plate section 23 (as well as a portion of the bottom plate section 22 closer to the side plate section 23, to be exact) by fillet welding. FIG. 4(*b*) clearly shows a weld bead wg 1 of the butt weld and a weld bead wg 2 of the fillet weld. It is noted that the shape of the groove in the weld zone is not shown in FIG. 4(*b*).

The bogie frame fitted with the mounting bracket 3 (the upper bracket member 31 and the lower bracket member 32) which has been welded to its cross beam 2 incorporates the functional part 4 via the mounting bracket 3.

In such a bogie frame of the first embodiment, the weld lines are relatively long and straight because of the configuration in which: a cross beam 2 with a rectangular cross section which includes a top plate section 21, a bottom plate section 22 and a pair of side plate sections 23, 24 is adopted; and then, a cutout opening 25 is formed in the top plate section 21 in such a manner that it extends to one of the side plate sections 23, the mounting bracket 3 is inserted in the cutout opening 25, and the mounting bracket 3 is joined to the top plate section 21 by butt welding. This configuration enhances welding workability for the mounting bracket 3 to be welded to the cross beam 2, and therefore enables automatic welding by a welding robot to be readily performed. Moreover, a variety of types of functional parts 4 can be mounted to the cross beam 2 simply by modifying the sizes and shapes of the mounting bracket 3 and the cutout opening 25 in accordance with individual specifications of railway vehicles. As a result, it is possible to provide a greater degree of design flexibility for the position where the functional part 4 is mounted.

Furthermore, it is also possible to increase the fatigue safety factor for the mounting bracket 3. The reasons for this are set out below. Based on general technical knowledge, fatigue strength (according to JIS-E-4207, for example) is higher at a base metal region than at a weld zone. In the conventional bogie frame, the weld zone between the mounting bracket 3 and the cross beam 2 is a shape-changing portion and thus stress concentration occurs in the weld zone. In contrast, in the bogie frame of the first embodiment, the weld zone between the mounting bracket 3 and the cross beam 2 (the top plate section 21) is a region formed by butt welding, and therefore stress concentration does not occur in the weld zone. Also, the mounting bracket 3, which is a monolithically formed component, may be formed to have a shape-changing portion in accordance with the position where the functional part 4 is mounted so that an area of stress concentration can be kept away from the weld zone. Moreover, the monolithically formed mounting bracket 3 can have an increased sectional area along the direction of sleepers that is perpendicular to the direction of rails as compared to a mounting bracket formed of a plurality of steel plates welded to each other as employed in the conventional bogie frame, and therefore has further reduced stress concentration. For the above reasons, the mounting bracket 3 of the bogie frame according to the first embodiment exhibits an increased fatigue safety factor.

Second Embodiment

Figure 5:
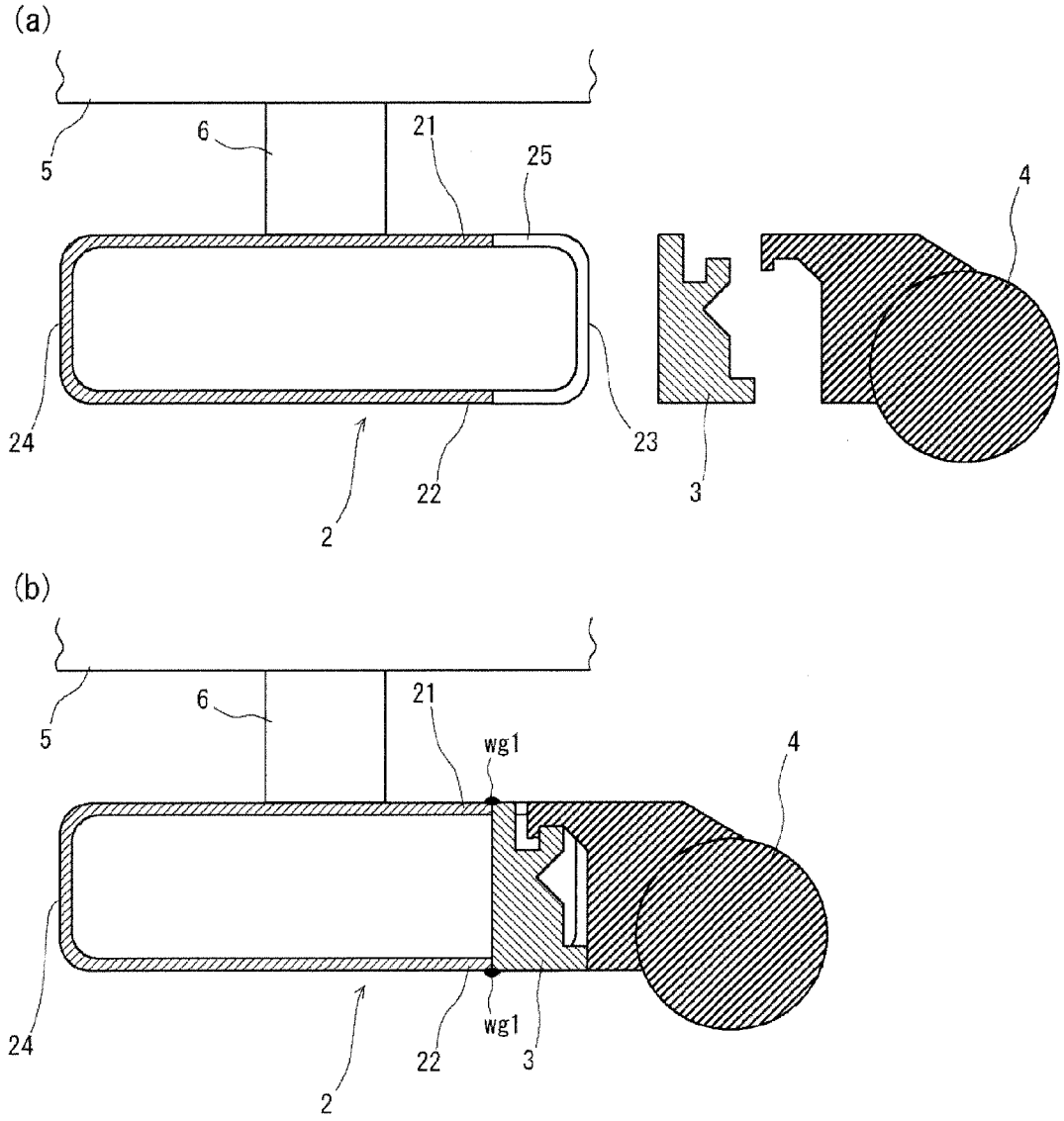
FIG. 5 shows cross-sectional views of a cross beam of the bogie frame in accordance with a second embodiment of the present invention, which schematically shows an example of a configuration for mounting a functional part.

FIG. 5 shows cross-sectional views of a cross beam of the bogie frame in accordance with a second embodiment of the present invention, which schematically shows an example of a configuration for mounting a functional part. FIG. 5(*a*) shows a state in which the functional part and the mounting bracket are detached from the cross beam, and FIG. 5(*b*) shows a state in which the mounting bracket has been joined to the cross beam and the functional part has been mounted thereon. The bogie frame of the second embodiment shown in FIG. 5 is a variation of the bogie frame of the first embodiment shown in FIG. 4, in which the configuration of the mounting bracket has been changed and accordingly the configuration of the cutout opening in the cross beam has been changed.

In the second embodiment, the mounting bracket 3 is not composed of two vertically separate parts as shown in FIG.

5. That is, the mounting bracket 3 of the second embodiment is composed of a single monolithically formed component that holds both upper and lower portions of the functional part 4 singly.

The cutout opening 25 of the second embodiment, as shown in FIG. 5(*a*), is provided to receive a single mounting bracket 3 and thus is not composed of two vertically separate openings. It extends from the top plate section 21 of the cross beam 2 through one of the side plate sections 23 thereof (the right-hand side plate section in FIG. 5) over to the bottom plate section 22 thereof.

The mounting bracket 3 is inserted in the cutout opening 25 of the cross beam 2, and the mounting bracket 3 is subjected to welding along the contour of the cutout opening 25. Specifically, as shown in FIG. 5(*b*), the mounting bracket 3 is joined to the top plate section 21 and the bottom plate section 22 of the cross beam 2 by butt welding, and joined to the side plate section 23 by fillet welding, although at a very small area in a lower portion thereof. The bogie frame fitted with the mounting bracket 3 which has been welded to its cross beam 2 incorporates the functional part 4 via the mounting bracket 3.

Such a bogie frame according to the second embodiment provides the same advantages as the bogie frame of the first embodiment as described above. The bogie frame of the second embodiment is particularly useful in the case in which the functional part 4 is to be mounted at a location lower than the top of the cross beam 2 and close thereto, i.e., the case in which the functional part 4 would interfere with the cross beam 2 if no measure is taken.

Third Embodiment

Figure 6:
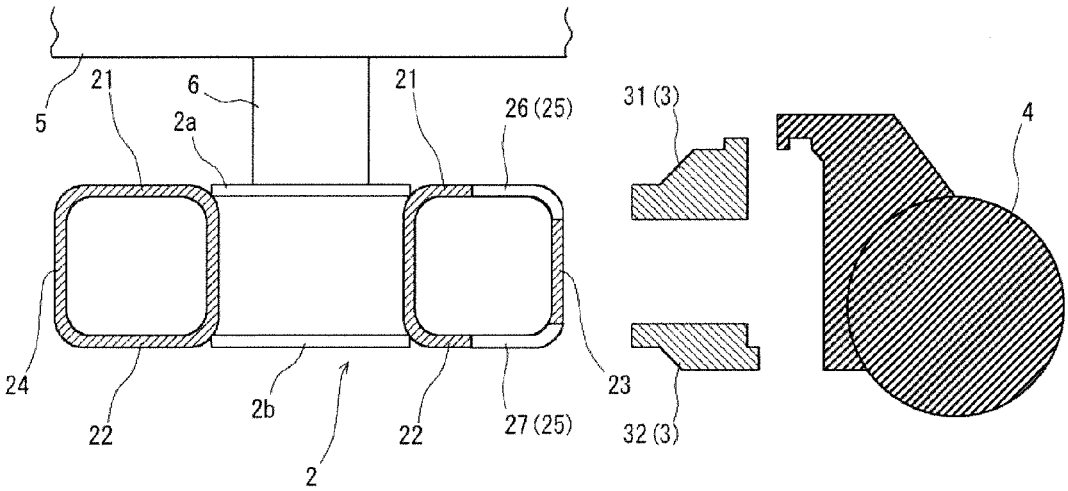
FIG. 6 shows cross-sectional views of a cross beam of the bogie frame in accordance with a third embodiment of the present invention, which schematically shows an example of a configuration for mounting a functional part.
Figure 6:
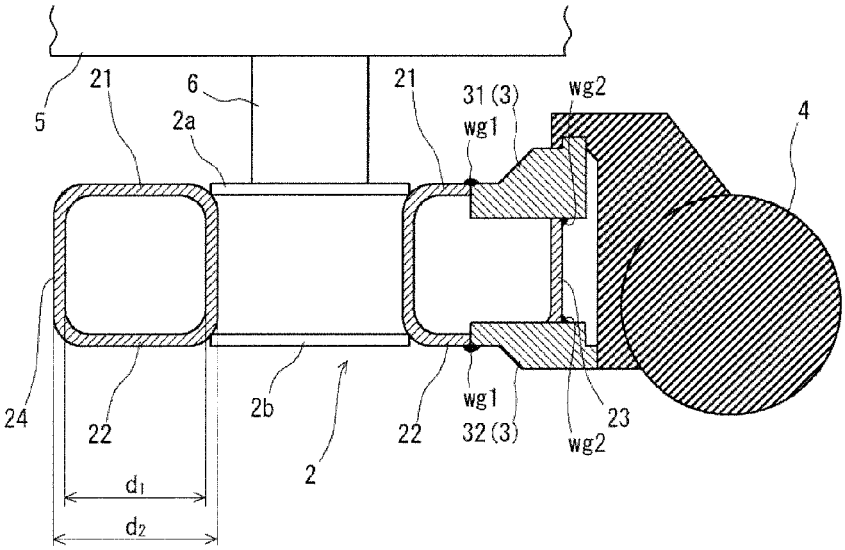

FIG. 6 shows cross-sectional views of a cross beam of the bogie frame in accordance with a third embodiment of the present invention, which schematically shows an example of a configuration for mounting a functional part. FIG. 6(*a*) shows a state in which the functional part and the mounting bracket are detached from the cross beam, and FIG. 6(*b*) shows a state in which the mounting bracket has been joined to the cross beam and the functional part has been mounted thereon. The bogie frame of the third embodiment shown in FIG. 6 is a variation of the bogie frame of the first embodiment shown in FIG. 4, in which the configuration of the cross beam has been changed.

In the third embodiment, the cross beam 2 is composed of two rectangular pipes each having a square cross section that are arranged in parallel to each other as shown in FIG. 6. Between the rectangular pipe cross beams 2 is disposed a pair of upper and lower reinforcing plates 2*a* and 2*b* which are welded thereto, similarly to the case of the round pipe cross beams 2 shown in FIGS. 1 and 2.

The cutout opening 25 of the third embodiment, as shown in FIG. 6(*a*), is composed of an upper cutout opening 26 for receiving the upper bracket member 31 and a lower cutout opening 27 for receiving the lower bracket member 32. The upper cutout opening 26 extends from the top plate section 21 of one of the two rectangular pipe cross beams 2 to one of the side plate sections 23 thereof (the right-hand side plate section in FIG. 6) which connects to the top plate section 21. The lower cutout opening 27 extends from the bottom plate section 22 of the rectangular pipe cross beam 2 where the upper cutout opening 26 is formed to one of the side plate sections 23 thereof (the right-hand side plate section in FIG. 6) which leads to the bottom plate section 22.

As with the first embodiment, the upper bracket member 31 and the lower bracket member 32 are inserted in the upper cutout opening 26 and the lower cutout opening 27, respectively, and a welding process is applied. Then, a functional part 4 is attached to the mounting bracket 3 (the upper bracket member 31 and the lower bracket member 32).

Such a bogie frame according to the third embodiment provides the same advantages as the bogie frame of the first embodiment as described above.

In particular, the bogie frame of the third embodiment provides the advantage of reduced stress, which is achieved by an increased second moment of area of the cross beam, as compared to the conventional bogie frame. The reasons for this are set out below.

Assuming that the cross beam of the bogie frame of the third embodiment and the cross beam of the conventional bogie frame have the same external dimensions, the second moments of area of them are compared. Specifically, in the case of the conventional cross beam, since it is a round pipe having a circular cross section, its outside diameter is $d_2$ and its inside diameter is $d_1$; and, in the case of the cross beam of the third embodiment, since it is a rectangular pipe having a square cross section, its outside width is $d_2$ and its inside width is $d_1$ (see FIG. 2 and FIG. 6(*b*)).

In this instance, in accordance with the formulae, the second moment of area $I_A$ of the conventional cross beam is determined by the following equation (1), and the second moment of area $I_B$ of the cross beam of the third embodiment is determined by the following equation (2):

$$I_A=(d_2^4\times d_1^4)\times\pi/64=0.049\times(d_2^4-d_1^4) \quad (1)$$

$$I_B=(d_2^4-d_1^4)/12=0.083\times(d_2^4-d_1^4) \quad (2).$$

Also, in accordance with the formula, the bending stress σ is determined by the following equation (3) based on the second moment of area I and the bending moment M.

$$\sigma=M\times h/I \quad (3)$$

where h is a height.

From the above equation (3), it is seen that, when the same bending moment is produced, the bending stress σ becomes smaller as the second moment of area I increases. When $I_A$ of the cross beam of the conventional bogie frame and $I_B$ of the cross beam of the third embodiment are compared based on the above equations (1) and (2), it is noted that the factor for the third embodiment is greater than that for the conventional art. Accordingly, in the bogie frame of the third embodiment, the bending stress acting on the cross beam is reduced as compared to the case of the conventional bogie frame. Thus, the advantage of reduced stress is achieved.

It is to be noted that the cross beam configuration of the bogie frame in the third embodiment may be applied to the bogie frame of the second embodiment as described above.

Fourth Embodiment

Figure 7:
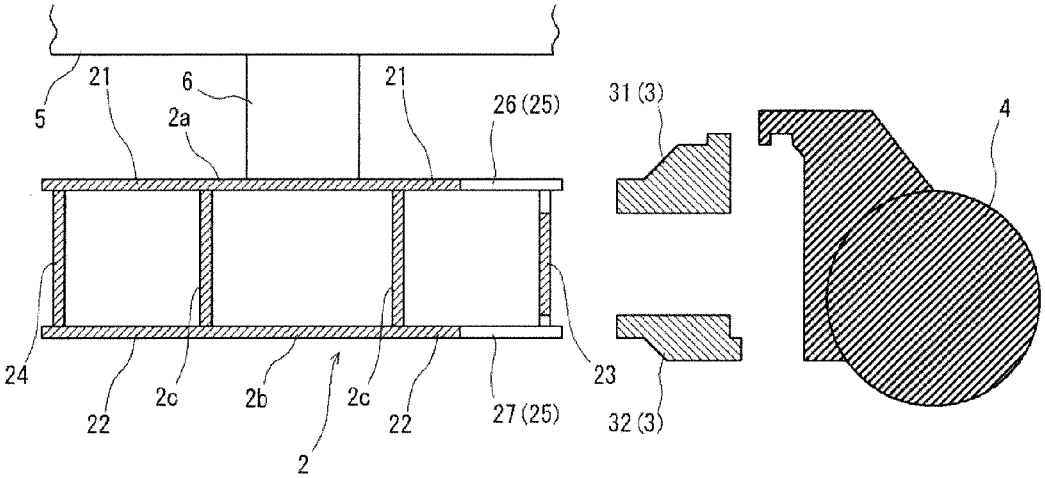
FIG. 7 shows cross-sectional views of a cross beam of the bogie frame in accordance with a fourth embodiment of the present invention, which schematically shows an example of a configuration for mounting a functional part.
Figure 7:
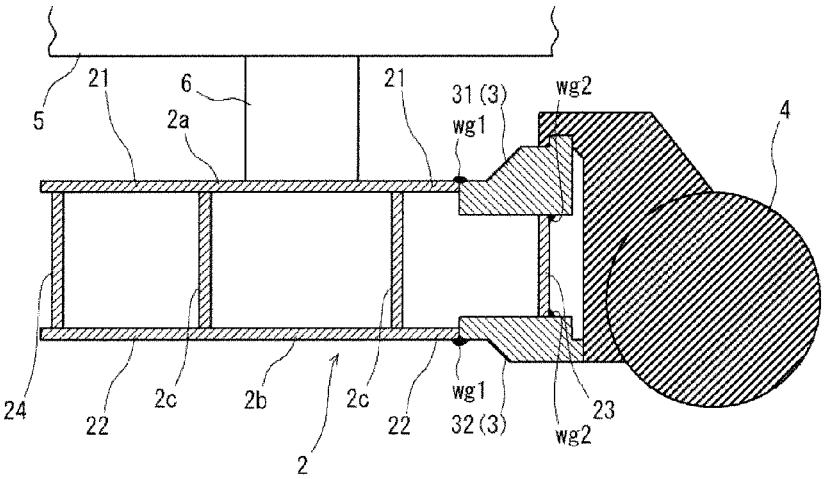

FIG. 7 shows cross-sectional views of a cross beam of the bogie frame in accordance with a fourth embodiment of the present invention, which schematically shows an example of a configuration for mounting a functional part. FIG. 7(*a*) shows a state in which the functional part and the mounting bracket are detached from the cross beam, and FIG. 7(*b*) shows a state in which the mounting bracket has been joined to the cross beam and the functional part has been mounted thereon. The bogie frame of the fourth embodiment shown in FIG. 7 is a variation of the bogie frame of the first embodiment shown in FIG. 4, in which the configuration of the cross beam has been changed.

In the fourth embodiment, the cross beam 2 is composed of four plates joined together in such a manner that it has a horizontally elongated rectangular cross section as shown in FIG. 7. Specifically, the cross beam 2 of the fourth embodiment is formed of steel plates joined together by welding, which constitute the respective sections, i.e., a top plate section 21, a bottom plate section 22, and a pair of side plate sections 23, 24. The cross beam 2 includes therein reinforcing ribs 2*c* disposed parallel to the side plate sections 23, 24 to ensure sufficient strength. As with the first embodiment, the cross beam 2 of this embodiment has an upper cutout opening 26 and a lower cutout opening 27.

As with the first embodiment, the upper bracket member 31 and the lower bracket member 32 are inserted in the upper cutout opening 26 and the lower cutout opening 27, respectively, and a welding process is applied. Then, a functional part 4 is attached to the mounting bracket 3 (the upper bracket member 31 and the lower bracket member 32).

Such a bogie frame according to the fourth embodiment provides the same advantages as the bogie frame of the first embodiment as described above.

It is to be noted that the cross beam configuration in the bogie frame of the fourth embodiment may also be applied to the bogie frame of the second embodiment as described above.

Fifth Embodiment

Figure 8:
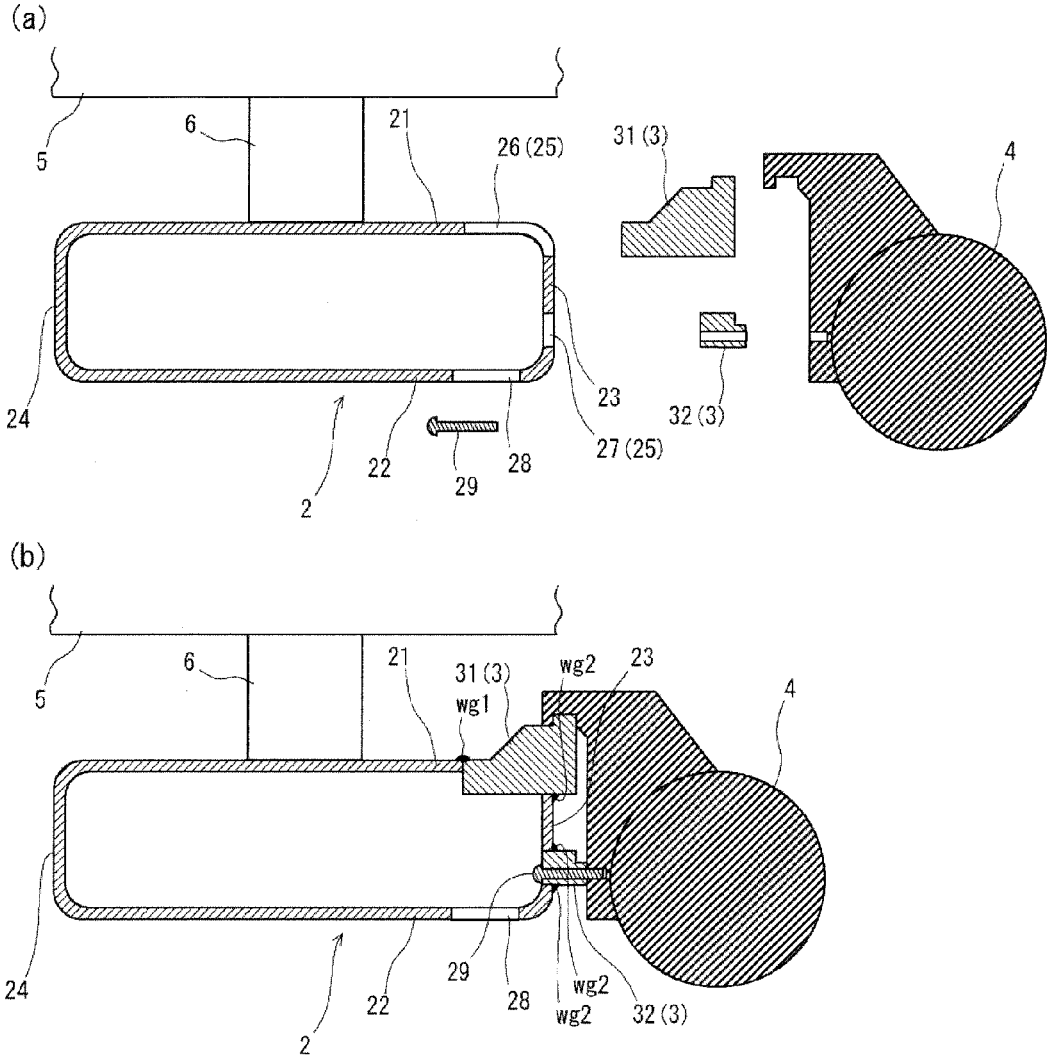
FIG. 8 shows cross-sectional views of a cross beam of the bogie frame in accordance with a fifth embodiment of the present invention, which schematically shows an example of a configuration for mounting a functional part.

FIG. 8 shows cross-sectional views of a cross beam of the bogie frame in accordance with a fifth embodiment of the present invention, which schematically shows an example of a configuration for mounting a functional part. FIG. 8(*a*) shows a state in which the functional part and the mounting bracket are detached from the cross beam, and FIG. 8(*b*) shows a state in which the mounting bracket has been joined to the cross beam and the functional part has been mounted thereon. The bogie frame of the fifth embodiment shown in FIG. 8 is a variation of the bogie frame of the first embodiment shown in FIG. 4, in which the configuration of the mounting bracket has been changed and accordingly the configuration of the cutout opening in the cross beam has been changed.

In the fifth embodiment, the mounting bracket 3 is composed of two vertically separate parts, an upper bracket member 31 and a lower bracket member 32, as shown in FIG. 8. The lower bracket member 32 is to be located above the lowermost portion of the cross beam 2.

As shown in FIG. 8(*a*), the top plate section 21 of the cross beam 2 has an upper cutout opening 26, extending to one of the side plate sections 23 (the right-hand side plate section in FIG. 8), for receiving the upper bracket member 31, as with the first embodiment. The side plate section 23 of the cross beam 2 has a lower cutout opening 27 for receiving the lower bracket member 32. In addition, the bottom plate section 22 of the cross beam 2 has an opening 28 for work in the vicinity of the lower cutout opening 27.

As with the first embodiment, the upper bracket member 31 is inserted in the upper cutout opening 26 of the cross beam 2, and a welding process is applied. Also, the lower bracket member 32 is inserted in the lower cutout opening 27 of the cross beam 2, and a welding process is applied. In this process, the lower bracket member 32 is joined to the side plate section 23 of the cross beam 2 by fillet welding as shown in FIG. 8(*b*). The bogie frame fitted with the mounting bracket 3 (the upper bracket member 31 and the lower bracket member 32) which has been welded to its cross beam 2 incorporates the functional part 4 via the mounting bracket 3. The functional part 4 is fixed to the lower bracket member 32 by a bolt 29, for example. The work of fixing may be performed through the opening 28 formed in the bottom plate section 22 of the cross beam 2.

Such a bogie frame according to the fifth embodiment provides the same advantages as the bogie frame of the first embodiment as described above.

It is to be noted that the mounting bracket configuration and the cross beam configuration of the bogie frame in the fifth embodiment may be applied to the bogie frames of the third and fourth embodiments as described above.

INDUSTRIAL APPLICABILITY

The bogie frame for railway vehicles of the present invention is useful in a variety of railway vehicle applications.

REFERENCE SIGNS LIST

1: side beam, 2: cross beam, 2*a*, 2*b*: reinforcing plate,
2*c*: reinforcing rib,
3, 3*a*, 3*b*, 3*c*: mounting bracket, 4: functional part,
5: vehicle body, 6: center pin,
21: top plate section, 22: bottom plate section, 23, 24: side plate section,
25: cutout opening, 26: upper cutout opening, 27: lower cutout opening,
28: opening, 29: bolt,
31: upper bracket member, 32: lower bracket member,
wg 1: weld bead of butt weld,
wg 2: weld bead of fillet weld

What is claimed is:

1. A bogie frame for railway vehicles, comprising:
a pair of left and right side beams disposed along a direction of rails;
a cross beam that connects the side beams to each other; and
a mounting bracket for mounting a functional part, the mounting bracket being joined to the cross beam,
wherein the cross beam has a rectangular cross section and includes a top plate section, a bottom plate section, and a pair of side plate sections; the top plate section has a cutout opening extending to one of the side plate sections; the mounting bracket is inserted in the cutout opening; and the mounting bracket and the top plate section are joined together by butt welding.

2. The bogie frame for railway vehicles according to claim 1, wherein the mounting bracket is a monolithically formed component formed by forging or machining.

3. The bogie frame for railway vehicles according to claim 1, wherein the cross beam comprises a joined-four-plate body, a rectangular pipe, or a press formed product.

4. The bogie frame for railway vehicles according to claim 2, wherein the cross beam comprises a joined-four-plate body, a rectangular pipe, or a press formed product.

* * * * *